United States Patent [19]

Peters

[11] 4,127,352

[45] Nov. 28, 1978

[54] PLACEMENT AND SUPPORT SYSTEM FOR STRIPS IN CONCRETE

[76] Inventor: Harlan J. Peters, 1160 S. Cypress St., La Habra, Calif. 90631

[21] Appl. No.: 859,913

[22] Filed: Dec. 12, 1977

Related U.S. Application Data

[63] Continuation-in-part of Ser. No. 692,565, Jun. 3, 1976.

[51] Int. Cl.[2] ..... E01C 11/02

[52] U.S. Cl. ..... 404/74; 85/5 P; 52/678; 404/68

[58] Field of Search ..... 404/68, 69, 50, 47, 404/48, 74; 85/5 P, 1 L; 52/677, 678, 679, 709

[56] References Cited

U.S. PATENT DOCUMENTS

| | | | |
|---|---|---|---|
| 844,296 | 2/1907 | Winslow | 52/678 |
| 1,538,619 | 5/1925 | Burrell | 404/50 |
| 1,571,700 | 2/1926 | Burrell | 404/50 |
| 1,604,990 | 11/1926 | Gregg | 404/50 |
| 1,664,370 | 3/1928 | Milburn | 52/678 |
| 1,909,458 | 5/1933 | Dieckmann | 404/119 |
| 2,016,858 | 10/1935 | Hall | 404/68 |
| 2,064,528 | 12/1936 | Fischer | 404/136 |
| 2,330,214 | 9/1943 | Heztzel | 404/68 X |
| 2,454,223 | 11/1948 | Shippee | 85/5 P X |
| 2,662,342 | 12/1953 | Peterson | 52/155 X |
| 2,711,097 | 6/1955 | Miller | 52/678 |
| 3,284,973 | 11/1966 | Ames | 52/679 X |
| 3,378,968 | 4/1968 | Shoemaker | 249/3 X |
| 3,487,743 | 1/1970 | Gutshall | 85/1 L |

FOREIGN PATENT DOCUMENTS

| | | | |
|---|---|---|---|
| 641,767 | 5/1962 | Canada | 85/1 L |
| 1,333,455 | 6/1963 | France | 52/678 |

*Primary Examiner*—Nile C. Byers, Jr.
*Attorney, Agent, or Firm*—Fulwider, Patton, Rieber, Lee & Utecht

[57] ABSTRACT

A system of placing and supporting elongated control joint strips, headers and the like preparatory to the pouring of a concrete slab, using elongated strips having V-shaped longitudinal bends, and spaced socket members defining non-circular sockets, in combination with stakes on non-circular cross section having two different effective transverse dimensions. The preferred stakes are of oval or elliptical cross section, with longitudinally spaced ring-like ribs on the shorter sides, and the preferred socket members are either integral U-shaped straps lanced from the strips, or separately formed brackets fitted onto the strips and having means defining non-circular sockets alongside the strips. A base plate, also with a non-circular socket, is provided for stabilizing stakes in a soft base such as sand, and related items include intersection brackets for connecting the adjacent ends of strips in a gridwork, and clips for securing together the overlapping ends of strips, two embodiments of such clips, one for control joints and one for headers, also having tabs formed with non-circular sockets for receiving stakes. The method of positioning and supporting the strips includes the steps of arranging the strips in rows, placing the stakes loosely through the sockets and into the ground, positioning each strip at a selected level along its stakes, and engaging the stakes in the sockets.

37 Claims, 25 Drawing Figures

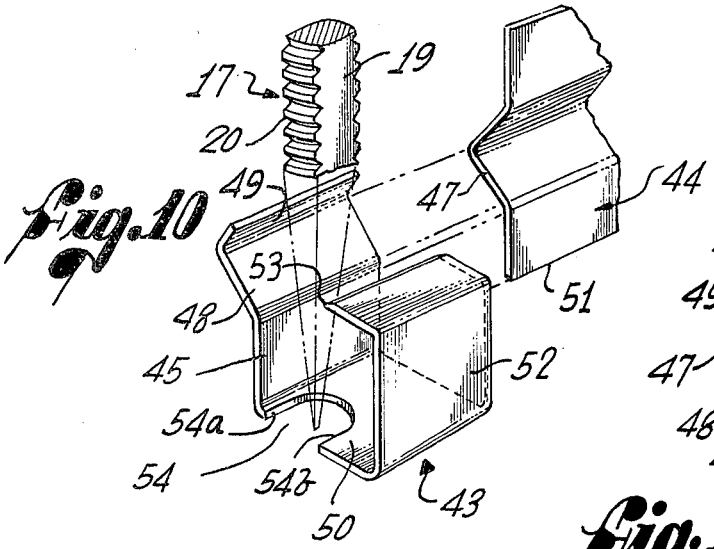
Fig. 10
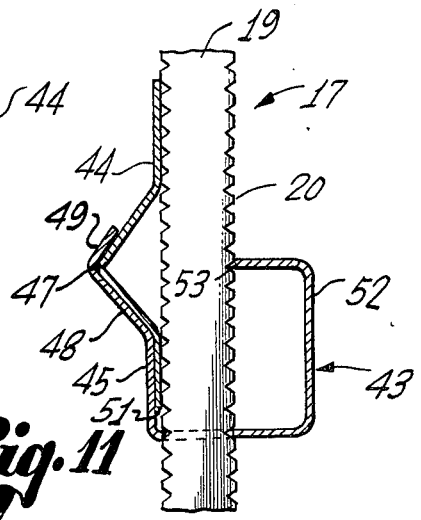
Fig. 11
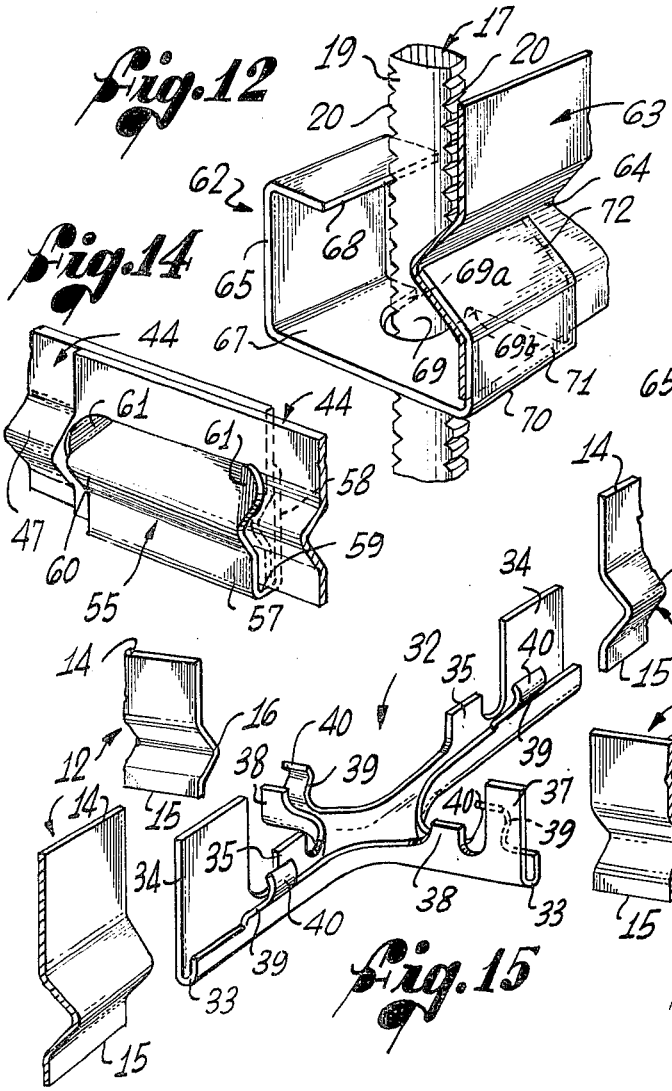
Fig. 12
Fig. 14
Fig. 15
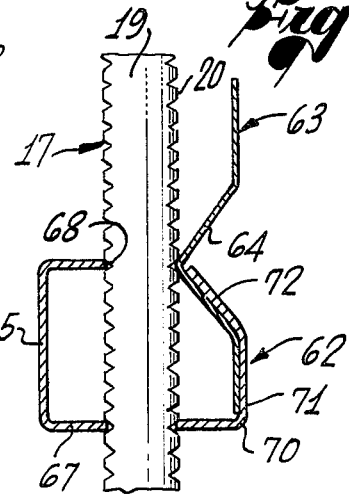
Fig. 13
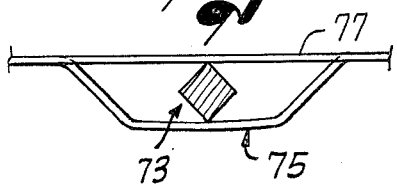
Fig. 16
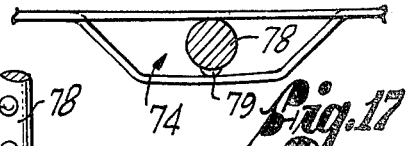
Fig. 17
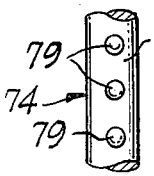
Fig. 18

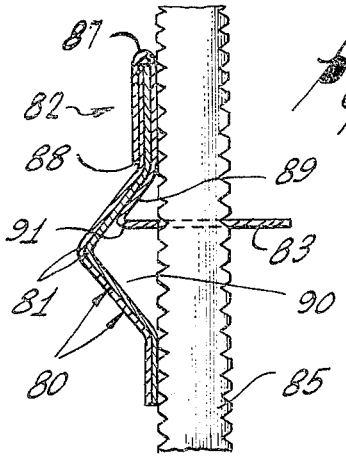
Fig. 20
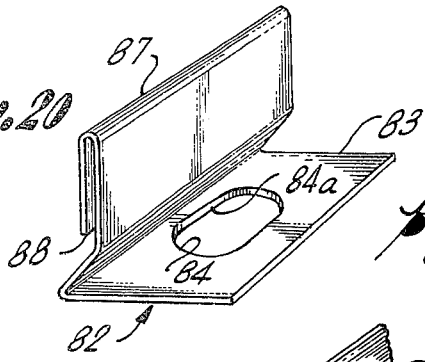
Fig. 21
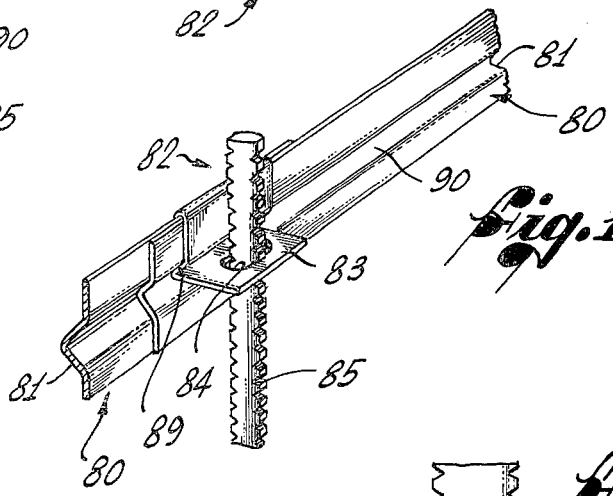
Fig. 19
Fig. 22
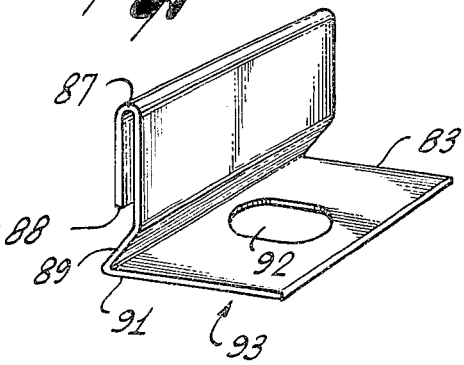
Fig. 23
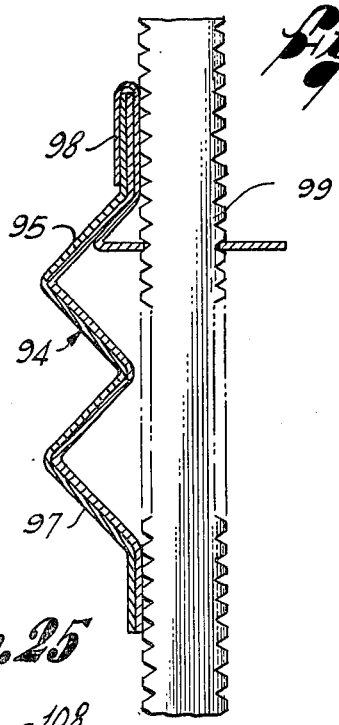
Fig. 24
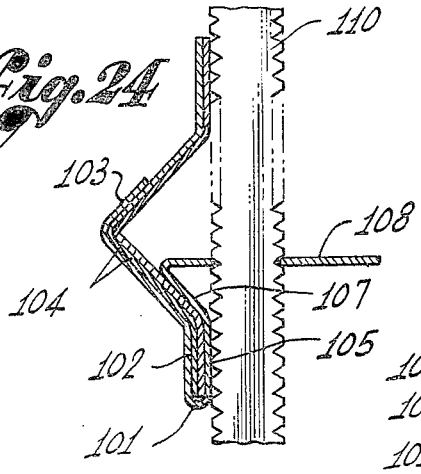
Fig. 25
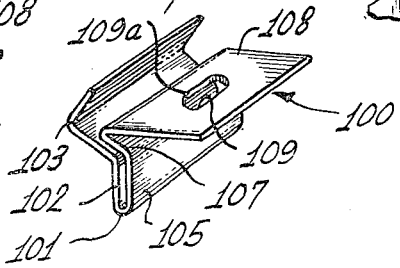

PLACEMENT AND SUPPORT SYSTEM FOR STRIPS IN CONCRETE

CROSS-REFERENCE TO RELATED APPLICATION

This application is a continuation-in-part of application Ser. No. 692,565, filed June 3, 1976, entitled Placement and Support System For Strips in Concrete.

BACKGROUND OF THE INVENTION

This invention relates to the laying of concrete slabs, including sidewalks, driveways, and the like, and has particular reference to the placement and support of elongated strips used in such operations, prior to pouring of the concrete. The invention is principally concerned with so-called control joint strips, which control the cracking of the concrete as it sets and cures, but also is applicable to the placement of other components, such as headers, that are used in connection with the laying of concrete.

In a typical process of laying a concrete slab, a suitable bed or base is graded to receive the concrete, and forms are provided to define the area upon which the concrete slab is to be laid, to confine the concrete to this area, and to serve as guides for leveling the surface of the concrete. Because concrete contracts as it sets and cures, a frequent practice is to provide means for controlling the resulting cracking of the concrete, and to promote cracking along regular lines or planes rather than in a haphazard and unsightly fashion. Such control means sometimes are referred to as expansion joints, but are more correctly called control joints.

One practice has been to saw cut grooves or score lines in the surface of the concrete as soon as is practical after it is poured, thereby weakening the slab along the score lines so that cracking hopefully will occur beneath them. In addition to being a time-consuming and expensive operation, saw-cutting has the disadvantage that cracking can commence during the delay between pouring and cutting, necessitated by the setting of the concrete.

As an alterative to saw cutting, elongated divider strips have been placed in the concrete, at or near the surface, to serve the same weakening function. One way to position such strips is to nail them, or otherwise attach them, to the forms on opposite sides of the slab, if spacing permits. Another approach, for larger slabs, is to mount the strips on the upper ends of stakes that are set in the ground in rows and carefully driven to the proper level to hold the strips very close to the surface of the concrete. Another approach has been to set plastic strips in the wet concrete after it has been poured. A strip of this type, with a tear-off top strip facilitating placement, is shown in U.S. Pat. No. 3,352,217.

While all of these approaches are satisfactory, in varying degrees, each has characteristics that make its results less than the optimum obtainable. Forms often are not close enough together to permit strips to be nailed to them, and the need for detachment when the forms are removed is a complication. Moreover, concrete settles as it sets, and rigidly set strips are not free to settle with the concrete.

When strips are mounted on the upper ends of stakes, the stakes must be very carefully set and leveled, and these strips also are not free to settle with the concrete as it settles. Of course, the stakes also are lost because they must remain in the slab.

Tear-top plastic strips have been popular because of their relative inexpensiveness and ease of installation, and also because the strips remain free to settle with the concrete. These strips, however, cannot be set prior to the pouring of the concrete, and, in fact, can be placed only after at least rough finishing has been completed. Thus, they cannot serve as guides in the finishing or "screeding" operation, a useful function performed by rigidly supported control joint elements.

A principal objective of the present invention is to provide an improved system of setting control joint strips and the like which has the advantageous features of the prior system, but without the significant disadvantages thereof.

SUMMARY OF THE INVENTION

The present invention resides in a novel supporting system for control joints, headers and the like wherein elongated strips are rigidly but releasably supported on removable and re-usable stakes in a manner which permits the strips to be quickly and easily adjusted in level along the stakes, securely holds the strips as the concrete is poured and screeded, and permits the stakes to be quickly and easily removed after the slab has been poured. Because the strips are releasably connected to, and adjustable on, the stakes, the stakes themselves do not have to be carefully set. After removal of the stakes, the strips are free to settle as the concrete settles. Finally, substantial economy results from the re-use of the stakes.

More specifically, the system of the present invention provides selectively engageable and releasable joints between the stakes and the strips, permitting the stakes to be driven freely into the ground, generally perpendicular to the strips, through sockets defined by socket members on the strips, either integrally formed on the strips or in separate brackets or clips attached to the strips, and then engaged with the sockets and locked in place relative to the strips by a quick and simple manipulation. After being engaged, the stakes hold the strips at the selected level during the pouring and screeding operations, after which the stakes are disengaged from the strips and pulled out of the concrete. This leaves the strips in the concrete, near the surface, and free to float in, and settle with, the concrete.

One embodiment of the socket member is an elongated, resiliently flexible strap of sheet metal that is lanced out of the body of a sheet metal strip and offset so one side thereof is a broad or flat "V", forming the socket as a triangular opening between the body and the strap. The preferred stake is of generally oval, or more technically, elliptical, cross section, and has peripherally extending ring-like knurls or ribs, the longer axis of the oval being longer than the maximum spacing of the lanced strap from the body of the strip, while the shorter axis of the oval is less than this spacing. Thus, a stake will pass freely through the socket with the longer axis of the oval substantially parallel to the body, but when the stake is rotated to turn the longer axis substantially perpendicular to the plane of the strip, it is wedged in the socket and locked in place, thereby locking the strip in place on the stake. The knurls and the flexibility of the lanced straps facilitate the locking and unlocking of the stakes.

Control joint strips may be made in selected lengths, such as 10 feet, with lanced socket members provided at selected intervals along their lengths. Such strips can be set and staked in end-to-end, overlapped relation, and gridworks of such strips can be constructed for large slabs, using intersection brackets to grip and support the strips where the ends of four strips come together at right angles. Additional socket members may be provided to receive nails or other pins to hold the overlapped portions of the strips together preparatory to driving of the stakes, or small clips can be used to hold these overlapped portions together.

An important addition for use in a soft base, such as sandy ground, is a disposable support plate having a noncircular socket hole through which the stake is driven into the ground, and in which the stake is anchored when it is rotated into locked engagement with the strip socket. Such plates prevent the stake from sinking in, or working loose, and are released and left in the concrete when the stake is disengaged from the strip and removed.

Alternative socket members include separately formed, disposable brackets that are fitted to the strips and define non-circular openings through which the stakes are freely insertible, and in which the stakes are selectively engageable after the strips have been set at the selected level. Such brackets preferably are shaped to receive and securely hold the strips, as long as the stakes are in place, and may simply drop away within the concrete after the stakes are removed, or may remain clipped to the strips after removal of the stakes.

The strips themselves may take various forms, but the preferred form has a longitudinal, V-shaped groove between its edges, providing longitudinal stiffness and also providing a key-locking effect in the concrete, in a basically conventional fashion. The width of the strip will vary, depending upon the circumstances, but typically will be less than the full depth of the concrete. This allows for aggregate interlocking, beneath the strip, which tends to prevent relative displacement of the two slab sections on opposite sides of the strip. Header strips customarily are wider than control joint strips, usually about 3½ inches to replace frequently used "2 × 4" lumber. One header strip has two V-shaped longitudinal grooves.

For headers, used along the outer edges of slabs, clips may be placed over the header strip, for ease of access for eventual removal. For control joints, where access for removal is not practical, and finishing operations make it necessary or desirable to have a smooth top edge on the strip, clips are applied from the underside of the strips, and left in place in the concrete.

Other aspects of the invention will become apparent from the following detailed description, taken in conjunction with the accompanying drawings.

BRIEF DESCRIPTION OF THE DRAWINGS

FIG. 10 is an enlarged fragmentary perspective view, with the parts in separated condition, showing an alternative form of the invention;

FIG. 11 is a fragmentary cross-sectional view of the parts in FIG. 10, in assembled condition;

FIG. 12 is a fragmentary perspective view, partially in cross section, of another alternative form of the invention;

FIG. 13 is a fragmentary cross-sectional view of the parts in FIG. 12, in assembled condition;

FIG. 14 is a fragmentary perspective view of two longitudinally overlapped strips and a clip for holding the overlapped ends together;

FIG. 15 is an exploded perspective view similar to FIG. 6 showing another form of an intersection bracket in relation to the end portions of four strips to be held thereby;

FIGS. 16 and 17 are views generally similar to FIG. 4 and schematically illustrating additional alternative forms of the stakes;

FIG. 18 is a fragmentary side elevational view of the stake shown in FIG. 17;

FIG. 19 is a fragmentary perspective view illustrating a partial header assembly, in a presently preferred alternative embodiment, comprising a clip joining together the overlapped ends of two header strips and also defining a non-circular socket for a non-circular stake;

FIG. 20 is an enlarged fragmentary cross-sectional view taken along line 20 — 20 of FIG. 19;

FIG. 21 is an isolated perspective view of the clip in FIG. 19;

FIG. 22 is a view similar to FIG. 21 showing a modification of the clip;

FIG. 23 is an enlarged view similar to FIG. 20 showing a modification of the header strips;

FIG. 24 is a view similar to FIG. 20 showing another presently preferred alternative embodiment, for control joints, using a clip joining together the overlapped ends of two control joint strips and also defining a non-circular socket for a non-circular stake; and FIG. 25 is an isolated perspective view of the clip in FIG. 24, shown on a reduced scale.

DETAILED DESCRIPTION (FIGS. 1 – 9)

Figure 1:
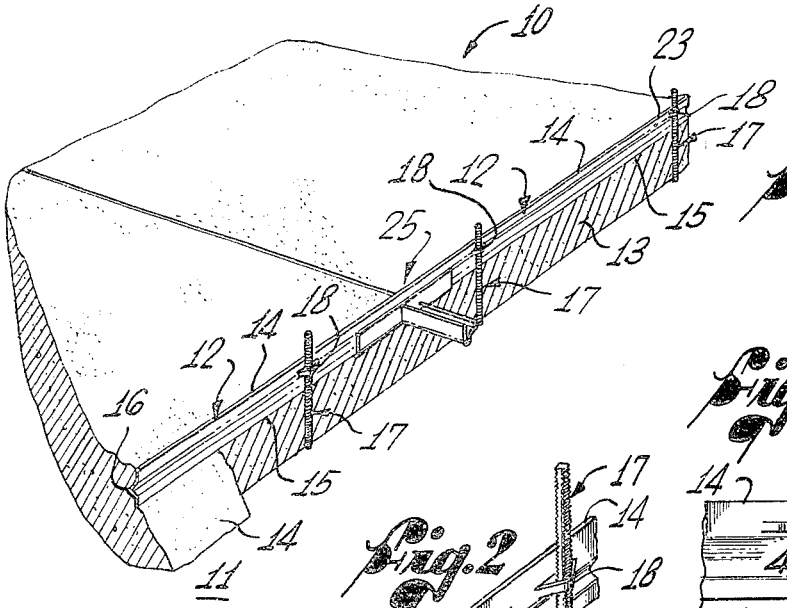
FIG. 1 is a fragmentary perspective view of a concrete slab that is being laid with the present invention, shown prior to the removal of the stakes but after pouring and leveling of one section of the slab.
Figure 2:
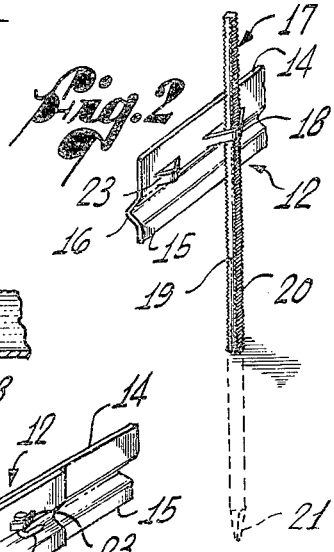
FIG. 2 is an enlarged fragmentary perspective view similar to part of FIG. 1, showing one stake and a section of a strip.

Shown in the drawings for the purposes of illustration is a representative section of a concrete slab 10 that has been poured on a prepared base 11 after a gridwork of elongated joint strips 12 has been positioned over the base, to control the cracking of the concrete as it cures and contracts. The illustrative slab section is shown with an upper surface that is substantially flush with the upper edges of the control joint strips, and also is shown with an exposed, substantially vertical side surface 13, although in actual practice, the concrete poured in such a section spills or bulges under the control joint strips to a substantially greater extent, generally as indicated at 14 at the left end of the surface in FIG. 1.

It is to be understood that the slab section 10 is only part of a larger concrete slab, and that another section is to be poured along the exposed side 13 in FIG. 1, as well as along other sides of this section. The invention can be used to construct large gridworks of control joints in this manner, for example, the floor of an industrial building, but also can be used for smaller slabs, such as sidewalks and driveways.

The control joint strip 12 has parallel upper and lower edges 14 and 15 and a longitudinal bend 16 of V-shaped cross section between its edges, extending the full length of the strip and forming a protruding longitudinal rib on one side of the strip and a corresponding longitudinal groove in the other side. This bend imparts longitudinal stiffness to the strip, which preferably is composed of relatively light sheet metal, and also forms a so-called "key joint" in the concrete, locking the sections of slab on opposite sides of the joint against relative displacement. The position of the V-shaped bend relative to the edges is not critical, but it should be spaced sufficiently below the upper edge 14 to allow for a substantial thickness of concrete above the bend, for sufficient strength to avoid breaking of the concrete in this area.

To support the control joint strips 12 above the ground 11 prior to pouring of the concrete 10, stakes 17 are spaced along the strips, two or more per strip, and are driven into the ground while generally perpendicular to the strips, and are connected to the strips to hold them at the desired level, with their upper edges 14 substantially at the level that is to be the level of the upper surface of the concrete when the latter is finished. In accordance with the present invention, these stakes are releasably engageable with socket members 18 on the strips 12, so as to be set in the ground prior to coupling engagement with the socket members, then engaged with the socket members after the latter and the strips have been positioned at the desired level, and subsequently disengaged from the socket members and removed, both engagement and disengagement being accomplished by a quick and simple manipulation of the stakes.

More specifically, the stake 17 is of non-circular cross section having two different effective dimensions, along angularly spaced transverse axes, and the socket member 18 defines a socket which also has two different effective transverse dimensions, along angularly spaced transverse axes, sized to receive the stake freely in one angular orientation of the stake, and to receive the stake with an interference fit in another angular orientation of the stake. Thus, the stake can be inserted in the socket and driven into the ground through the socket while remaining loose, or free, in the socket, and then turned through a selected angle into the interference-fit orientation, to become wedged and locked in the socket member.

Figure 4:
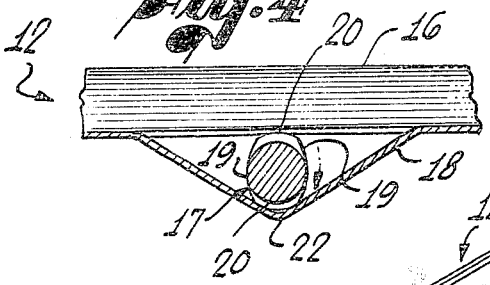
FIG. 4 is an enlarged fragmentary view taken substantially along line 4 — 4 of FIG. 3.

As shown most clearly in FIG. 4, the preferred stake 17 is generally elliptical or oval in cross section, having two relatively long side surfaces 19 and relatively short side surfaces 20. The short side surfaces are arcuately curved, and the longer side surfaces are either flat or curved on a larger radius, as shown in FIG. 4. For firm gripping engagement with the socket member, at least the short side surfaces are knurled, that is, formed with longitudinally spaced, ring-like ribs. One end 21 of the stake preferably is tapered to facilitate driving into hard ground.

In one embodiment, the socket member 18 is a V-shaped strap of sheet metal that is integral with the control joint strip 12 on one side of the latter, the side opposite the V-shaped bend 16, and having an apex 22 that is spaced from the strip a distance substantially greater than the minimum cross-sectional thickness of the stake. Thus, the straps and the strips define triangular sockets that are elongated longitudinally of the strips. The straps are sufficiently thin as to be resiliently flexible to some extent, for wedging interaction with the stakes.

Figure 3:
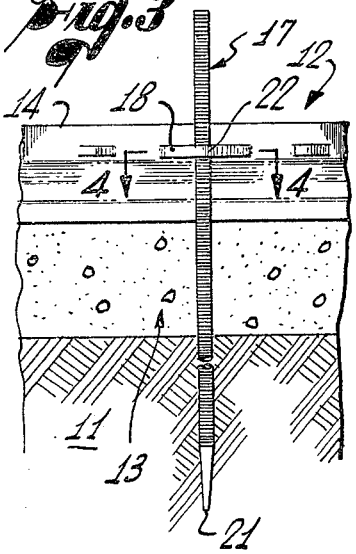
FIG. 3 is an enlarged fragmentary side elevational view of one of the stakes in FIG. 1.

Such socket members can be formed simply by lancing the strips 12, that is, making two parallel cuts, as shown in FIG. 3, in a strip 12, and displacing the strap of metal between the cuts laterally outwardly from the strip. It will be evident that a bowed strap will function in a manner similar to the V-shaped strap.

Such socket members 18 are formed at selected locations along each strip, for example, one adjacent each end of a strip and one or more in the central portion of the strip. The intervals are not critical, but it is desirable to provide socket members for receiving stakes at intervals on the order of 3 to 5 feet along the strips.

Figure 5:
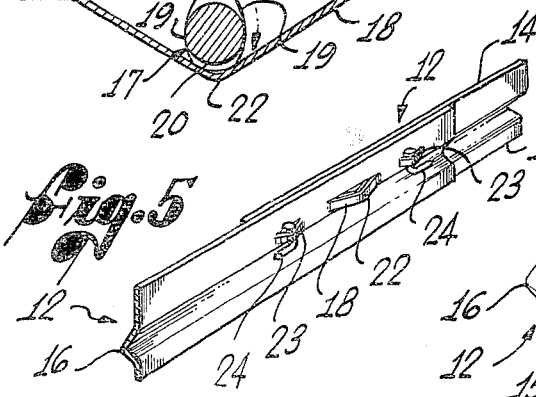
FIG. 5 is a fragmentary perspective view showing the overlapped and pinned condition of two strips.
Figure 9:
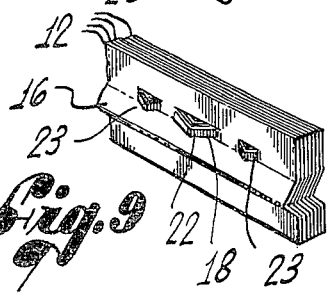
FIG. 9 is a fragmentary perspective view of a stack of strips shown in the nested condition used for transportation and storage.

In addition, two smaller offset straps 23 may be formed adjacent each end of each strip 12, as shown in FIGS. 5 and 9, for use in pinning the overlapping end portions of two end-to-end strips together. These straps 23 are spaced to nest together, when the ends are overlapped, and when so nested, to define a relatively small socket for receiving a nail or other pin, as shown at 24 in FIG. 5. The nails tie the strips securely together, and provide continuity of the control joint from one strip to the next.

Compactness of stacking for storage and transportation, and convenience of handling, is an important consideration in the design of materials of this type. It will be seen in FIG. 9 that control joint strips 12 for use in the present invention will nest snugly together in a compact bundle, with the V-shaped bends nested in the corresponding grooves, and with the straps 18 and 23 interfitting through the spaces from which they were lanced.

Where four strips 12 come together at right angles in a control joint gridwork, as shown in FIG. 1, it is desirable to provide an intersection bracket 25 for joining all four ends securely together and holding the strips at the proper level. Such an intersection bracket may take various configurations, the important consideration being that all four strips be securely gripped and joined together by a means that is below the upper edges 14 of the strips.

Figure 6:
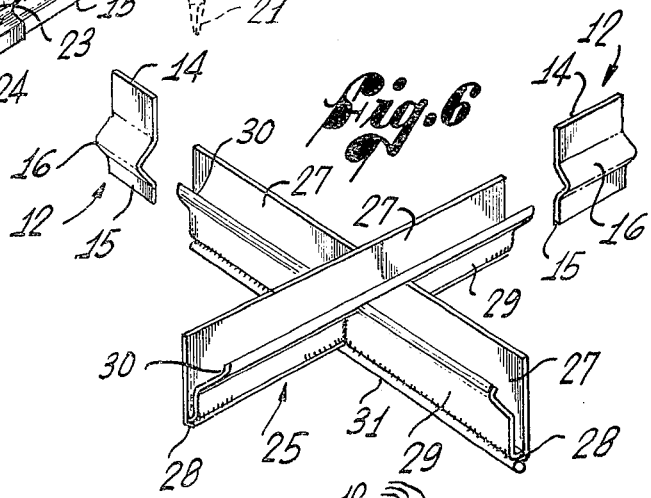
FIG. 6 is a perspective view of one representative intersection bracket, with fragmentary views of strips to be inserted in the bracket.

The illustrative intersection bracket 25 shown in FIGS. 1 and 6 is, in effect, two upwardly opening troughs of resiliently flexible material, such as sheet metal, shaped to receive and grip the four control joint strips with snap fits. For this purpose, each trough has one flat and upright sidewall 27, a narrow bottom wall 28, and an opposite contoured sidewall 29 that first extends upwardly, parallel to the sidewall 27, to define a narrow channel for receiving the lower edge portion of a strip 12, then is inclined outwardly away from the sidewall 27 at an angle corresponding to the angle of one side of the V-shaped bend, and then curls back toward the sidewall 27, at 30, to snap lock over the apex of the V-shaped bend.

One of the troughs is continuous, and the other is made in two sections that are welded or otherwise joined to the central portion of the first trough, at right angles thereto. A reinforcing rod 31 is welded across the bottom of the interrupted trough, for extra strength.

Shown in FIG. 15 is a modified embodiment of an intersection bracket 32 that may be made as a one-piece sheet metal stamping. Again, the bracket defines, in effect, two troughs disposed at right angles, each having a narrow bottom channel defined by an upwardly opening U-shaped bend 33. On one side of each bend are upwardly projecting flat co-planar tabs, one trough having two long tabs 34 and two shorter tabs 35, while the other has one long tab 37 and two shorter tabs 38. On the opposite side of each trough are two outwardly inclined tabs 39 with free end portions 40 that curl back, to overlie the apex of a V-shaped bend 16, as in the first embodiment. Thus, the two embodiments are functional equivalents, but the second embodiment is capable of being mass-produced as a sheet metal stamping more economically than the first embodiment.

Since concrete slabs frequently are poured on relatively soft bases, such as sand, ground or gravel, problems can be encountered in secured setting relatively small stakes in such a base. With the present invention, these problems are overcome by providing flat and disposable base plates 41 for selected stakes 17, and engaging and disengaging each stake with the associated base plate as an incident to the engagement and disengagement of the stake with the socket member 18.

Figure 8:
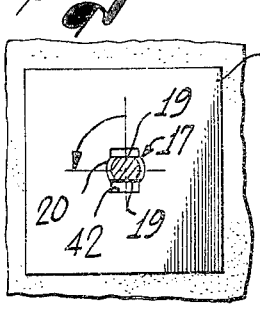
FIG. 8 is a fragmentary cross-sectional view taken along line 8 – 8 of FIG. 7, with the stake being turned into locked engaged with the support plate.
Figure 7:
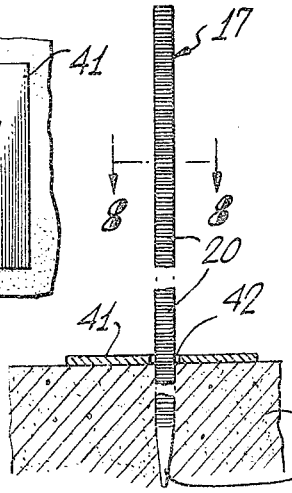
FIG. 7 is a side elevational view of a stake, shown in a support plate, which is in cross section.

As shown in FIGS. 7 and 8, an illustrative base plate 41 is a square of suitable material such as sheet metal having a central opening 42 defining a socket for coacting with a stake 17 in a manner similar to the co-action of the socket members 18. This opening may be simply an elongated rectangle sized to pass a stake freely through the plate when the longer axis of the oval cross section is aligned with the longer axis of the opening. The opening is narrower, however, than the thickness of the stake along the longer axis of the oval, so that the stake can be wedged in the opening upon rotation through ninety degrees. If the thickness of the plate is the same as, or slightly less than, the spacing of the ribs on the stake, the wedging action is somewhat easier and the locking more positive, because the place interlocks with the ribs.

FIGS. 10 and 11 show an alternative form of socket member 43 that replaces the lanced straps 38, and is made as a separate part for releaseably engaging a stake 17 and supporting a control joint strip 44 thereon. The use of the separtely formed socket members 43 has the advantage of greater versatility, as far as placement of stakes and overlapping of strips are concerned, but involves the cost of additional parts. On the other hand, the control joint strips 44 need to be lanced to form integral socket members, and thus are somewhat simpler in construction.

The illustrative separate socket member 43 is a generally U-shaped bracket composed of suitable material, such as sheet metal, and having one side portion, on the left in FIG. 10, for holding a strip 44 and an opposite side portion for receiving a stake 17. The strip-supporting side portion has an upright lower section 45 for engaging a control joint strip 44 below the V-shaped bend 47 in the strip, an outwardly inclined section 48 for extending outwardly along the lower side of the bend, and a short return 49 for fitting over the apex of the bend. A bottom wall 50 of the bracket extends horizontally across the lower edge 51 of the strip 44 from the upright section 45, as shown in FIG. 11, and an L-shaped section 52 of the bracket projects upwardly from the opposite side of the bottom wall and back toward the strip-supporting portion, terminating in a free edge 53 that is engageable with a stake 17. The free edge 53 preferably is beveled to lock into the knurled stake.

The socket in this bracket 43 is formed in part by a U-shaped notch 54 in one side of the bottom wall 50, and in part between the free edge 53 and a control joint strip 44 that is placed in the bracket. When the strip is in place, an oval stake 17 is inserted through the slot defined between the free edge 53 and the flat side of the strip, with the longer axis of the oval generally parallel to the longitudinal axis of the strip, as shown in FIG. 10. The width of this slot is sufficient to receive the stake freely in this angular position. The U-shaped notch 54 in the bottom wall 50 is aligned with the slot defined above, having one side 54$^a$ is spaced from the upright vertical 45 by approximately the thickness of the sheet metal of the strip 44, and an opposite side 54$^b$ that is generally aligned with the free edge 53. Thus, the stake will pass freely through both the slot and the notch when it is positioned for insertion.

The transverse width of both the slot and the notch is less than the maximum effective width of the stake, so that rotation of the stake through a quarter turn wedges the stake in the bracket, as it did in the first embodiment. This condition is shown in FIG. 11, wherein it will be seen that the stake bears on one side against the flat side of the strip, holding it firmly in the V-shaped section of the bracket, and also bears firmly against the walls of the notch and against the free edge 51, the latter being resiliently yieldable to some extent because of the flexibility of the sheet metal.

Lanced straps 23 of the type provided in the first embodiment could be provided in strips used with separately formed brackets 43, but such straps fix the amount of overlap that is required if two end-to-end strips are to be pinned together. For greater versatility, the straps are eliminated, along with the socket-defining straps 18, and the overlapped ends are secured together by small clips 55, as shown in FIG. 14.

These clips 55 are simple sheet metal stampings, having two legs 57 and 58 shaped to straddle two overlapped strips 44 and clamp them firmly together. Preferably, the legs define a U-shaped groove 59 for fitting over the lower edges of the overlapped strips and extending upwardly along opposite sides of the strips far enough to insure firm gripping, one leg 58 being flat and the other having a V-shaped bend 60 conforming to the contour of the longitudinal bends 47 in the strips. The ends 61 of the free edge portions of the contoured leg 57 are bent outwardly, and inclined away from the straight leg 58, to facilitate insertion of the clip onto the strips. The entire free edge portion of either leg could be inclined away from the other leg for the same purposes.

Shown in FIGS. 12 and 13 is another alternative embodiment which is similar to the embodiment in FIGS. 10 and 11, except that the strip-engaging section of the bracket 62 is modified to receive a strip 63 with the V-shaped longitudinal bend 64 facing in the opposite direction, that is, toward the stake 17. These brackets are designed for use with strips serving as headers, rather than as control joints, and for this use, it is desirable to have the stake 17 and the bend 64 on the same side, and the groove in the bend on the other side, so that concrete can be poured on the grooved side, leaving the stake 17 outside the concrete.

It will be seen in FIGS. 12 and 13 that the left side portion of the bracket 62 is the same as the right side portion of the bracket 43 in FIGS. 10 and 11, including an L-shaped section 65 extending upwardly from a bottom wall 67 and terminating in a free edge 68 for engaging a stake 17. The bottom wall has a U-shaped notch 69 in one side, with one wall $69^a$ of the notch aligned with the free edge 68. From the other side $69^b$ of the notch, however, the bottom wall 67 extends beyond the notch a distance approximately equal to the total transverse thickness of the strip 63, and is joined by a right-angle bend 70 to an upright section 71 for lying against the strip below the bend 64. This section carries at its upper end an inwardly inclined section 72 for lying against the lower portion of the V-shaped bend, within the groove therein, and thus holding the strip 63 firmly in the bracket 62.

In this instance, the upper slot is defined between the free edge 68 and the apex of the bend 64 in the control joint strip 63, this slot being aligned, as before, with the notch 69 in the bottom wall 67. The stake 17 is insertible freely through the slot and the notch with the longer axis of the oval cross section parallel to the longitudinal axis of the strip 63, and is wedged in the slot and the notch by a quarter turn of the stake.

Shown in FIGS. 19 through 21 is a presently preferred embodiment of the invention, designed primarily for use as a header, that is, as a form along the outer side of a slab, in circumstances where so-called "2-by-4's" presently are used. Preferably, the header strips 80 are made about three and one-half inches wide (the actual width of a 2-by-4) and have at least one V-shaped longitudinal stiffening bend 81. As shown in FIG. 19, two such strips arranged in end-to-end overlapping relation and are joined together by a special bracket in the form of a clip 82 which is releasably attached to the overlapped portions, and which has a laterally projecting tab 83 formed with a non-circular socket 84, for receiving and engaging a non-circular stake 85, as in the previous embodiments.

The preferred clip 82, which in a header assembly can and should be applied over the tops of the strips 82, is a sheet metal part having a slim U-shaped bend 87 at its top, sized to fit tightly over a double thickness of the strips, as shown in FIG. 20. One side of the U-shaped bend (on the left in FIG. 20) terminates in a free edge 88, spaced from the closed end of the bend 87 a distance less than the spacing of the stiffening bend 81 in the strip from the upper edge of the strip. The other side of the bend (on the right in FIG. 20) continues downwardly, and preferably is bent to form a detent 89 for interfitting with the longitudinal groove 90 in the overlapped strips and thereby locking the clip releasably to the strips. Herein, this detent is an inclined wall of the clip, disposed at substantially the same angle as the adjacent wall of the stiffening bend.

The tab 83 laterally from the lower end of the detent 89, being integrally joined thereto by a bend 91, and preferably is normal to the plane of the flat portions of the strip, so as to be horizontal when the strip is disposed in a vertical position. The socket 84 in this case is a generally elliptical opening in the tab, substantially larger than the cross section of the stake 85, having a longer axis that extends longitudinally of the strips.

The shorter axis of the socket opening 84 is made slightly shorter than the longer axis of the stake, but longer than the shorter axis of the stake, and the longer axis of the opening is substantially longer than the longer axis of the stake. Thus, the stake fits freely into the socket opening, and can be turned a quarter turn into a wedged and engaged condition as before.

It can be seen in FIGS. 20 and 21 that that socket opening 84 is located with one of its longer $84^a$ aligned with the adjacent flat side of the U-shaped bend, so that the stake, when engaged, will bear against the clip above the socket, as shown in FIG. 20 for increased stability of the clip and the strips relative to the stake. Although this is the preferred arrangement, a different socket orientation, shown in FIG. 22, is available for a different purpose.

In FIG. 22, the socket 92 is turned ninety degrees, so that the longer axis in the clip 93 will be normal to the strips. With this arrangement, the longer axis of the stake, when engaged, is substantially parallel to the strips, so that the stake is "broadside" in the ground to the principal displacement forces exerted on the assembly. This provides somewhat increased resistance to displacement of the stake, while sacrificing some degree of rigidity between the stake and the clip. In all other rspects, the clip 93 in FIG. 22 may be the same as the clip 82 in FIG. 21.

23 merely illustrates a different header strip 94 having two V-shaped longitudinal stiffening ribs 95 and 97 to increase the longitudinal stiffness in a strip of substantial width. The clip 98 and stake 99 shown in FIG. 23 are the same as those shown in FIGS. 19 to 21.

In each of these header embodiments, the clip is attached over the top edge of the header strip, for ease of access for removal after the concrete has set up at least sufficiently for removal of the header assembly. Thus, both the stakes and the clips may be re-used. Although the clips produce bumps on the otherwise smooth top surfaces of the header strips, this does not create a significant problem in finishing operations because of the nature and location of the header strips, around the periphery of a slab.

With respect to control joint strips, however, such bumps would have an adverse effect on finishing operations, and would definietly be objectionable if allowed to remain in the finished slab. Accordingly, clips for control joint strips should not be applied over the tops of the strips.

The presently preferred clip 100 for use in control joints is shown in FIGS. 24 and 25, and utilizes the same basic approach as the header clips, except for snapping onto the strips from below. For this purpose, the clip 100 has a U-shaped bend 101 with a closed lower end, and the left side 102 of the bend, as viewed in FIG. 24, carries a V-shpaed detent 103 for snapping over the stiffening bends 104 of the stips, while the right side 105 of the bend 101 carries a detent 107 similar to the detent 89 in FIG. 20. A socket-defining tab 108 extends laterally from this detent, as before, and has a non-circular socket opening 109 positioned therein to receive a stake in the position shown in FIG. 24. The side $log^a$ of the socket opening is positioned so that the stake 110 bears against the upper flat portion of the strip, as shown in FIG. 24.

With both of these socket-in-clip embodiments, the lack of dimensioning versatility that characterizes the first embodiment is eliminated, and strips of standard lengths (such as eight feet or ten feet) can be overlapped to varying degrees to accommodate differing slab dimensions, without need for cutting. Thus, the clips allow universal dimensioning of strip systems with standard strip lengths as a result of the variable overlapping made possible by the clips. Although any desired number of clips and stakes may be used on each strip, including clips sized to fit a single thickness, between overlapped ends, if desired, normally clips and stakes will be required only at the overlapped areas.

Shown in FIGS. 16 and 17 are two alternative cross-sectional stake configurations 73 and 74 usable in the present invention. Neither of these is a desirable as the oval stake 17 of the other embodiments, but each has the basic characteristic of different effective transverse dimensions along different angularly spaced transverse axes, so as to be rotatable in a socket having these characteristics, from a free position to a wedged position.

The cross section shown in FIG. 16 is square, to fit within a lanced socket member 75 that is offset away from the strip 77 and preferably flattened in the operative area, being spaced from the strip a distance only slightly greater than the thickness of the stake between its flat sides. The thickness of the stake across its corners, however, is greater than the width of the socket, and the stake thus can be wedged in the socket by a small turn. Because of the corner-to-flat-suface engagement, however, the stake will be less stable in the engaged condition.

The stake 74 shown partially in FIGS. 17 and 18 has a cylindrical body 78, but in addition has a longitudinal row of small studs 79 on one side, making the stake non-circular in effective cross section. This stake will be quite similar in operation to an oval stake with longitudinally spaced ribs, and would be almost identical if two rows of studs were provided, along opposite sides of the cylindrical body. The cost of fabrication will be considerably higher than for the oval stake.

The method of laying concrete using stakes and strips in accordance with the invention should be readily apparent from the foregoing description of the components and their functions, but a summary of the method may be useful in gaining a full appreciation of the invention. Assuming that the base 11 (FIG. 1) has been prepared to receive the concrete 10, with suitable forms (not shown) around the boundary, control joint strips are set up in a selected pattern, typically a gridwork for a large slab, in the following manner.

After the desired spacing and pattern have been determined, in accordance with principles that are known in the art, the strips are laid out in parallel rows across the slab area, extending in both directions at right angles to each other to form the gridwork. The strips in each row are staked by one or more workmen, who simply insert the stakes loosely through the socket members, position the strips longitudinally, and drive the stakes into the ground, In soft ground, a base plate if fitted over the stake before it is driven in.

When a stake has been set, the control joint strip simply is raised to the proper level along the stake, and the latter is turned to engage it in the socket member and in the base plate if one is being used. If the strips 44 with separate socket brackets 43 are being used, the brackets are positioned longitudinally on the strips before the stakes are inserted, and the stakes then are driven, as with the other strips. If the strips with socket-forming clips are used, the clips are applied to the overlapped ends of each pair of strips to join them together, after which the stakes are inserted and driven, as with the other embodiments.

As a control joint strip is being set, it is a simple matter to adjust the height to the proper level. Stakes can be pulled out or driven in to some extent, or they can be disengaged for adjustment of the strip along the stakes, and then re-engaged in the proper position. The upper end portions of the stakes are left projecting far enough above the strips for easy access and removal after the concrete is poured.

With the strips 12 of the first embodiment, the overlapped ends are pinned together with nails 24 that are inserted through the smaller lanced sockets 23, and with the strips 43 of the second embodiment, clips 55 are fitted onto the overlapped end portions to clamp them together. With the socket-forming clips 100, of course, this function is performed as an incident to the installation of the clips on the strips.

Where two rows intersect, as shown in FIG. 1, the ends of the strips at the intersection are fitted into an intersection bracket, as shown in FIGS. 6 or 14. When such a bracket is snapped into place, the four strips are securely supported at the intersection.

When all of the strips are in place, staked and leveled, concrete is poured in the usual manner, within the forms and around the strips and the stakes, filling each section of the gridwork to the desired level for the various operations, which typically commence shortly after pouring commences.

The control joint strips, being rigidly supported near the desired level of the surface of the concrete, provide guides for assisting in the screeding of the concrete to the desired level. After this has been done, a workman, preferably using a simple gripping tool (not shown), removes each stake simply by turning the stake through the required angle to release it, and pulling the stake from the strip (and from the base plate, if one was used). The wet concrete around the strips holds the latter in place as the stakes are removed.

At this stage, the strips are positioned in the concrete in the desired pattern, near the surface, and are free to settle with the concrete as it sets. Additional finishing operations can be performed without disturbing the control joints.

As the concrete sets and cures, the control joints provide regular planes of weakness in the slab, and promote cracking along these planes, rather than in unsightly random patterns. Of course, the strips remain in place to assist the normal aggregate interlock in keying adjacent sections of a slab together, to resist relative displacement.

When the invention is used in the placement of a header, as illustrated in FIGS. 12, 13 and 20 through 23, the only significant difference is the use of the reversed bracket 62 or the socket-defining clip 82, which places the groove, rather than the rib, on the side of the strip opposite the stake, and maintains the stake outside the area to be occupied by the slab. Although header strips typically will be somewhat wider than control joint strips, they still will often be narrower than the full depth of the concrete slab, to allow concrete to flow under the strip, generally as indicated at 14 in FIG. 1. Where two connected slabs are to be poured at different times, this flow under the header should improve the interlock between the slabs.

From the foregoing, it will be evident that the present invention provides a novel system for placing and supporting elongated strips in the laying of concrete and the like, with the principal advantages of prior art systems and without the principal disadvantages. As a result, substantial economies in time and material are made possible, and an improved end product is obtained.

It also will be evident that, while several specific embodiments have been illustrated and described, various modifications and changes can be made within the spirit and scope of the invention.

I claim:

1. For use in the laying of a concrete slab on a prepared area of ground forming a base for the slab, the combination of:

an elongated control joint strip composed of sheet metal having substantially parallel longitudinal edges and a longitudinal bend between said edges stiffening said strip and forming a rib on one side thereof and a groove in the other side;

at least two V-shaped, socket-defining straps extending longitudinally of said strip beside said bend and spaced apart longitudinally thereof, each of said straps being integrally joined at its ends to said strip, and being displaced laterally from the strip on the side thereof opposite said rib and having an apex spaced a preselected distance from said strip, thereby defining a generally triangular socket alongside the strip; and at least two elongated stakes for supporting said strip above said base, each of said stakes having a generally oval cross section with one transverse axis that is sufficiently shorter than said preselected distance to allow said stakes to pass freely through the socket, and with another transverse axis that is sufficiently longer than said preselected distance for the stakes to become wedged in the sockets upon rotation therein;

whereby the strip may be positioned loosely on the stakes with the latter driven into the ground, adjusted in level along the stakes while the latter are disposed in one angular position, locked releasably in place by rotation of the stakes in said socket-defining straps, and then released by rotation of the stakes, for removal of the stakes from the strips.

2. The combination defined in claim 1, wherein each of said stakes has two relatively short sides of arcuate cross-sectional shape, two longer and flatter sides, and longitudinally spaced, transverse ribs along said relatively short sides.

3. The combination defined in claim 1 further including at least one base plate having a non-circular socket through which one of the stakes extends, said base plate being disposed on the ground and said socket being sized and shaped to be engaged in the socket and locked releasably to the stake upon rotation of the latter.

4. The combination defined in claim 3 wherein said socket is an elongated rectangular opening in said plate.

5. For use in the laying of a concrete slab on a prepared area of the ground forming a base for the slab, the combination of:

an elongated strip composed of sheet metal and having substantially parallel longitudinal edges and a longitudinal bend between said edges stiffening said strip and forming a rib on one side thereof and a groove in the other side;

at least two socket-defining brackets fitted onto said strip in longitudinally spaced relation, each of said brackets having means thereon for receiving and gripping a portion of the strip, and means thereon defining a non-circular socket in the bracket alongside the strip having two angularly spaced axes of different lengths; and at least two elongated stakes for supporting said strip above said base, each of said stakes having a generally oval cross section with a first relatively short transverse axis and a second relatively long axis angularly spaced from said first axis, said stakes being sized for free insertion in said sockets in one angular position relative to said sockets, and to be wedged in said sockets to lock said brackets and said strips releasably on the stakes upon rotation of the stakes.

6. The combination defined in claim 5 wherein each of said socket-defining brackets is a generally U-shaped part having one contoured side portion engaging the side of said strip having said rib thereon, a bottom wall extending under the strip, and a generally L-shaped second side portion extending from said bottom wall along the side of the strip having said groove therein and then toward the strip above said bottom wall to a free edge portion spaced a preselected distance from the strip;

said bottom wall having a notch therein constituting part of said non-circular socket, and said strip and said free edge defining a slot above the notch also constituting part of said socket.

7. The combination defined in claim 6 in which said contoured side portion is contoured to follow the contour of the lower portion of the strip onto the rib, and to at least partially overlie the latter to lock the strip in the bracket.

8. The combination defined in claim 5 wherein each of said socket-defining brackets is a generally U-shaped part having one contoured side portion engaging the side of said strip having the groove therein, a bottom wall extending under the strip, and a generally L-shaped second side portion extending from said bottom wall along the side of said strip in spaced relation with the rib and then toward the rib above said bottom wall to a free edge portion spaced a preselected distance from the rib, said bottom wall having a notch therein constituting part of said non-circular socket, and said rib and said free edge defining a slot above the notch also constituting part of said socket.

9. The combination defined in claim 8 in which said contoured side portion is contoured to follow the contour of the lower portion of said strip into said groove, to lock the strip in the bracket.

10. The combination defined in claim 7 wherein said brackets are formed as clips, each having a U-shaped bend for fitting over one edge portion of said strip, a detent on one side of said bend interfitting with said longitudinal bend of the strip to hold the clip on the strip, and a tab projecting laterally from the strip on one side thereof, said socket being formed in said tab.

11. The combination defined in claim 10 wherein said sockets are elongated, generally elliptical openings, each having a longer axis substantially parallel to the plane of the strip, and in which one edge of said opening is closely adjacent that plane.

12. The combination defined in claim 10 wherein said sockets are generally elliptical openings, each having a longer axis substantially normal to the plane of the strip.

13. The combination defined in claim 5 in which a second elongated strip similar to the first-mentioned strip is disposed in end-to-end overlapped relation with the first-mentioned strip, and said brackets are mounted on the overlapped portions thereof, each bracket being formed as a clip having a U-shaped bend fitting tightly over one edge portion of the overlapped strips, a detent on one side of the overlapped strips interfitting with the longitudinal bends thereof to hold the clip in place, and a tab projecting laterally from the overlapped strips on one side thereof, said socket being formed in said tab.

14. The combination defined in claim 13 in which said U-shaped bend is fitted downwardly over the upper edges of said overlapped strips, in a header assembly.

15. The combination defined in claim 14 in which said detent is a portion of said clip fitting into said groove on one side of the overlapped strips and said tab projects laterally from the opposite side thereof.

16. The combination defined in claim 13 in which said U-shaped bend is fitted upwardly over the lower edges of said overlapped strips in a control joint assembly.

17. The combination defined in claim 16 in which said detent is a V-shaped bend in said clip on one side of said overlapped strips fitting over the bend of the strips, said clip having a second detent on the other side fitting into said groove and carrying said tab.

18. The combination defined in claim 5 wherein each of said stakes has two relatively short sides of arcuate cross-sectional shape, two longer and flatter sides, and longitudinally spaced, transverse ribs along said relatively short sides.

19. For use in the laying of a concrete slab on a prepared area of the ground forming a base for the slab, the combination of:

an elongated strip of relatively stiff material having substantially parallel longitudinal edges;

at least two socket members on each strip and spaced longitudinally apart along the strip;

each of said socket members including means defining a non-circular socket opening on one side of the strip for receiving a stake substantially perpendicular to the strip, and having two different effective dimensions along different, angularly spaced, transverse axes of the socket; and at least two elongated stakes insertible through said sockets and having non-circular cross-sectional shapes with different effective dimensions along different, angularly spaced, transverse axes, said stakes being sized for insertion freely through said sockets in one angular orientation, and to be wedged therein upon turning to a different angular orientation.

20. The combination defined in claim 19 wherein said socket members are fitted onto said strips and each has means for gripping the strip, and means defining the socket.

21. The combination defined in claim 19 wherein each of the stakes is generally oval in cross section, having two relatively short arcuate sides and two longer and flatter sides.

22. The combination defined in claim 21 wherein said shorter sides are formed with longitudinally spaced ring-like ribs.

23. The combination defined in claim 13 further including base plates having non-circular socket openings through which said stakes extend, for resting on the ground, said socket openings being sized and shaped to receive the stakes freely in one angular orientation, and for wedging the stakes in the openings upon rotation to a different angular orientation.

24. An assembly for use in laying concrete slabs and the like over a prepared base, and comprising:

a plurality of elongated strips arranged in a row in end-to-end relation;

socket-defining means on said control joint strips spaced longitudinally along said row and forming a plurality of non-circular sockets alongside said control joint strips, said sockets having two different effective dimensions along different, angularly spaced transverse axes; and a plurality of elongated stakes in said sockets having non-circular cross-sectional shapes with two different effective dimensions along different angularly spaced transverse axes, said stakes being sized for insertion freely through said sockets in one angular orientation and to be wedged therein upon turning to a different angular orientation;

whereby said strips and said socket-defining means are adjustable on said stakes to selected levels while the stakes are loose in said sockets, and the stakes are rotatable to lock the strips and the socket-defining means in place, and then rotatable to the loose position for removal.

25. An assembly as defined in claim 24 in which said socket-defining means are fitted onto said strips in selected longitudinally spaced locations, and have means thereon for defining said sockets and for holding the strips on the stakes when the latter are wedged in said sockets.

26. An assembly as defined in claim 24 in which said strips have longitudinally overlapped end portions, and said socket-defining means are clips fitted onto said overlapped portions, said clips having means thereon for holding said overlapped portions together and holding the clips in place, and laterally projecting portions with openings therein forming said sockets.

27. An assembly as defined in claim 24 further including a plurality of base plates for holding said stakes in soft ground, said base plates having non-circular socket holes therein through which said stakes extend, said socket holes being sized and shaped to receive said stakes loosely in one angular orientation, and to be wedged releasably onto the stakes in another angular orientation.

28. An assembly as defined in claim 27 in which said socket hole is a generally elongated rectangular hole, and the cross section of said stakes is oval, having a shorter transverse axis shorter than the shorter dimension of the hole, and a longer transverse axis shorter than the longer dimension of the hole but longer than said shorter dimension.

29. An assembly as defined in claim 27 in which said stakes have two short arcuate sides and two longer and flatter sides, said shorter sides having longitudinally spaced ring-like ribs thereon.

30. An assembly as defined in claim 24 further including a second draw row of said strips, intersecting the first row substantially at a right angle, and similarly supported by stakes and socket-defining means, and further including, at the intersection of said rows, an intersection bracket comprising two upwardly opening troughs disposed at a right angle to each other, and having side walls shaped to fit snugly around and grip said strips, thereby to securely support the strips at the intersection and tie the two rows together.

31. An assembly as defined in claim 30 in which said strips have longitudinal V-shaped bends spaced above their lower edges forming ribs on one side and grooves on the other side, and said intersection bracket comprises a one-piece sheet metal stamping defining two intersecting and upwardly opening channels for receiving the lower edges of the strips at the intersection of said rows, means for engaging the grooved sides of the strips, and means for engaging the sidewalls of the strips having said ribs thereon, and gripping the ribs to hold the bracket on the intersection.

32. An assembly as defined in claim 31 in which the first-mentioned means are flat tabs extending upwardly from the sidewalls of the channels, and in which the second-mentioned means are contoured tabs inclined outwardly to follow the contour of the ribs and having short returns for overlying the ribs.

33. The method of positioning and supporting elongated strips in the laying of concrete slabs and the like on the ground, comprising the steps of:

providing a plurality of elongated strips in sections of preselected lengths, and a plurality of socket members spaced along the strips to receive stakes;

providing a plurality of stakes that are insertible freely through said socket members and are selectively engageable and disengageable upon rotation thereof to lock the socket members and the strips in place along the stakes and to release the socket members and the strips;

positioning the strips in a row with the socket members spaced along the row, by inserting the stakes loosely through the socket members, driving the stakes into the ground, and positioning each strip at a selected level by raising it and the associated socket members to the selected level and then rotating the stake to lock the socket members in place on the stake; and after pouring of the concrete, disengaging the stakes and removing them from the socket members, leaving the latter and the strips in place.

34. The method used in claim 33 in which the socket members are provided with non-circular sockets and the stakes are provided with non-circular cross-sectional shapes that are engageable and disengageable upon rotation through a selected angle in the socket members, and in which engagement and disengagement operations are performed by rotating the stake through the selected angle.

35. An assembly for use in laying concrete slabs and the like over a prepared base, and comprising a plurality of elongated strips arranged in a row in end-to-end relation;

socket-defining means on said control joint strips spaced longitudinally along said row and forming a plurality of non-circular sockets alongside said control joint strips, said sockets having two different effective dimensions along different, angularly spaced transverse axes; and a plurality of elongated stakes in said sockets having non-circular cross-sectional shapes with two different effective dimensions along different angularly spaced transverse axes, said stakes being sized for insertion freely through said sockets in one angular orientation and to be wedged therein upon turning to a different angular orientation;

said socket-defining means being brackets fitted onto said strips in selected longitudinally spaced locations, and having means thereon for defining said sockets and for holding the strips on the stakes when the latter are wedged in said sockets, said brackets being generally U-shaped, having one side portion for engaging and holding one side of a strip, and a bottom wall extending under said strip, said bottom wall having a socket opening on the side of said strip opposite said one side portion to receive a stake on that side.

36. An assembly as defined in claim 35 in which each of said brackets further includes a generally L-shaped second side portion extending upwardly from said bottom wall in spaced relation with said opposite side of said strip and bending back toward said strip, and having a free edge spaced a preselected distance from said strip to define a slot, said slot being aligned with the socket opening in said bottom wall to cooperate therewith in defining a socket.

37. For use in the laying of a concrete slab on a prepared area of ground, the combination of:

a plurality of elongated strips of relatively stiff material, said strips being arranged in a row in end-to-end overlapping relation;

socket-defining clips attached to said strips in the overlapped areas thereof, said clips having means thereon holding the strips together, and laterally projecting tabs thereof formed with non-circular socket openings, and non-circular stakes insertible freely through said socket openings and sized and shaped to be wedged therein upon rotation of the stakes, thereby to lock the clips and the strips releasably to the stakes.

* * * * *

UNITED STATES PATENT AND TRADEMARK OFFICE

CERTIFICATE OF CORRECTION

PATENT NO. : 4,127,352

DATED : Nov. 28, 1978

INVENTOR(S) : Harlan J. Peters

It is certified that error appears in the above-identified patent and that said Letters Patent are hereby corrected as shown below:

| | | | | |
|---|---|---|---|---|
| Column 7, | line | 21 | - | Word "secured" should be --securely--; |
| Column " | " | 42 | - | Word "place" should be --plate--; |
| " " | " | 52 | - | After word "need" delete "to" and insert therefore --not-- . |
| " 8 | " | 18 | - | After "54a" insert --that-- |
| " 10 | " | 24 | - | Insert --FIG.-- before 23; |
| " " | " | 51 | - | Word "shpaed" should be --shaped--; |
| " " | " | 53 | - | Word "stips" should be --strips-- . |
| " 11 | " | 8 | - | Change "a" to --as-- |
| " 16 | " | 51 | - | After word "second" delete "draw" |

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*